United States Patent [19]

Wollman

[11] 4,432,655

[45] Feb. 21, 1984

[54] INTEGRATED WATCH CASE AND BRACELET ASSEMBLY

[75] Inventor: Jack Wollman, Manhasset, N.Y.

[73] Assignee: Bulova Watch Company, Inc., Flushing, N.Y.

[21] Appl. No.: 433,964

[22] Filed: Oct. 13, 1982

[51] Int. Cl.[3] ..... G04B 37/00

[52] U.S. Cl. ..... 368;282; 224/164

[58] Field of Search ..... 368/276, 281, 282; 224/164–177

[56] References Cited

U.S. PATENT DOCUMENTS

| | | | |
|---|---|---|---|
| 2,446,065 | 7/1948 | Starke | 368/282 |
| 3,975,899 | 8/1976 | Haber | 368/282 |

FOREIGN PATENT DOCUMENTS

| | | | |
|---|---|---|---|
| 280560 | 5/1952 | Switzerland | 368/282 |
| 337465 | 5/1959 | Switzerland | 368/282 |
| 380035 | 3/1964 | Switzerland | 368/282 |
| 473421 | 7/1969 | Switzerland | 368/282 |
| 570647 | 7/1975 | Switzerland | 368/282 |

*Primary Examiner*—Vit W. Miska

*Attorney, Agent, or Firm*—Michael Ebert

[57] ABSTRACT

A watch case and metal bracelet assembly in which the tail ends of the bracelet components are attachable to the complementary ends of the case in a manner simulating a "soldered look," yet these components may readily be detached to replace the bracelet. The case which is adapted to accommodate the watch movement has straight ends each provided with a longitudinal groove, the case having at its midpoint adjacent each end a threaded bore to receive a holding screw which when turned in penetrates the related groove. Each bracelet component terminates in a split tail pin which is slidable into the groove at the complementary end of the case and is locked therein by the holding screw which when turned in extends into the mid space between the half pieces of the pin; hence to detach the component from the case, one has merely to turn out the screw.

6 Claims, 6 Drawing Figures

13
11
6
10
W
10F
12
14
21
20
15
10E1
16
19
10R
10EE
17
18

INTEGRATED WATCH CASE AND BRACELET ASSEMBLY

BACKGROUND OF INVENTION

This invention relates to timekeeping wrist watches, and in particular to a watch case and metal bracelet assembly in which the components of the bracelet are linked to the complementary ends of the case in a manner simulating a "soldered look," the arrangement being such that one may readily attach or detach the bracelet component.

In conventional modern watches, the timekeeping movement is housed within a metal case provided with a pair of projecting lugs at either end. Each pair of lugs is bridged by a retractable cross bar having spring-biased pins or pintles extending axially therefrom to be received within small cavities formed in the lugs. The watch strap or bracelet associated with the case may be fabricated of leather, plastic, metal or other flexible material, the strap being constituted by two complementary components whose adjacent ends terminate in a buckle, a clasp or other means to join the components together at a position appropriate to the size of the wearer's wrist. The other ends or tails of the strap components are in a looped formation or are provided with a fixture having a transverse bore to admit the cross bar, thereby linking the components to the case.

The conventional case and bracelet arrangement makes it a relatively simple matter to couple or decouple the strap or bracelet components. In order, therefore, to replace a worn bracelet with a fresh bracelet of the same or a different design, one need only displace the pintles inwardly with a suitable tool to release the cross bar from the lugs, after which the bars are removed from the worn bracelet component and inserted in the loops or bores of the fresh components which are then linked to the projecting lugs of the case.

From the standpoint of aesthetics or ornamental design, a conventional linked case and bracelet assembly in which the case is provided with opposing pairs of projecting lugs is incompatible with modern design trends. Current design directions reflect the "minimalist" school of art and is toward extreme simplicity and the avoidance of detail. In order, therefore, to create a watch case and bracelet having a severe and uncluttered appearance, it is now the practice with metal bracelets to weld or solder the bracelet components to the ends of a case having no projecting lugs. This simple integration of bracelet and case has an appearance that is often referred in the trade to as the "soldered look."

The "soldered look," though it satisfies modern design trends, has distinct practical drawbacks. If the bracelet is worn or damaged and in need of replacement, or the wearer wishes to replace an existing metal bracelet with a bracelet having a different ornamental appearance, he cannot do so; for the bracelet is permanently integrated with the case. Hence, to replace a damaged bracelet one must first take the watch movement out of the case and insert it into a new integrated case and bracelet combination, even though the case may still be in good condition.

In the copending patent application of Bernard Hesselschwerdt, Ser. No. 362,848, filed May 29, 1982, entitled "Wrist Watch Case & Bracelet Assembly," the tail ends of the bracelet components are attached to the complementary ends of the case in a manner simulating a "soldered look," yet the components may be detached to replace the bracelet. The case, which is adapted to accommodate the watch movement, has a generally rectangular shape. The ends at the rear face of the case each have a notch therein to define a broad ledge bordered by fingers. Bridging the fingers on each end is a retractable cross bar having axially-extending pins which are socketed in cavities formed in the fingers, the bar being raised slightly above the ledge. Received within each ledge is the tail of a respective bracelet component, the tail having a transverse groove therein to admit the cross bar which acts to link the component to the case. The ledge overlaps the front face of the tail so that the linked component appears to be integrated with the case.

Thus in the Hesselschwerdt assembly, as in prior art arrangements, use is made of cross bars which are separable from the case and bracelet, and which make it necessary for the assembly to retract the spring-biased pins extending axially from the bars into order to join the bracelet to the case or to detach the bracelet therefrom. While an experienced jeweler having a tool appropriate to the operation has little difficulty in manipulating the retractable bars, the typical watch wearer cannot readily carry out this operation.

SUMMARY OF INVENTION

In view of the foregoing, the main object of this invention is to provide a watch case and metal bracelet assembly in which the components of the bracelet are linked to the complementary ends of the case in a manner simulating a "soldered look."

A significant advantage of an integrated case and bracelet assembly in accordance with the invention is that the wearer himself may readily attach or detach the components of the bracelet without the need for special tools for this purpose. A further advantage resides in the fact that an existing bracelet may be replaced with fresh components of the same or different design while retaining the same watch case, thereby obviating the need to transfer the movement to a new case.

Also an object of the invention is to provide a low-cost assembly of the above type in which, as seen from the front face of the watch case, the components of the bracelet appear to be integrated with the case.

Briefly stated, these objects are attained in a watch case and metal bracelet assembly in which the tail ends of the bracelet components are attachable to the complementary ends of the case in a manner simulating a "soldered look," yet these components may readily be detached to replace the bracelet. The case which is adapted to accommodate the watch movement has straight ends each provided with a longitudinal groove, the case having at its midpoint adjacent each end a threaded bore to receive a holding screw which when turned in penetrates the related groove. Each bracelet component terminates in a split tail pin which is slidable into the groove at the complementary end of the case and is locked therein by the holding screw which when turned in extends into the mid space between the half pieces of the pin; hence to detach the component from the case, one has merely to turn out the screw.

OUTLINE OF DRAWINGS

For a better understanding of the invention as well as other objects and further features thereof, reference is made to the following detailed description to be read in conjunction with the accompanying drawings, wherein.

DESCRIPTION OF INVENTION

Figures 1, 2, 3, 4, 5, 6:
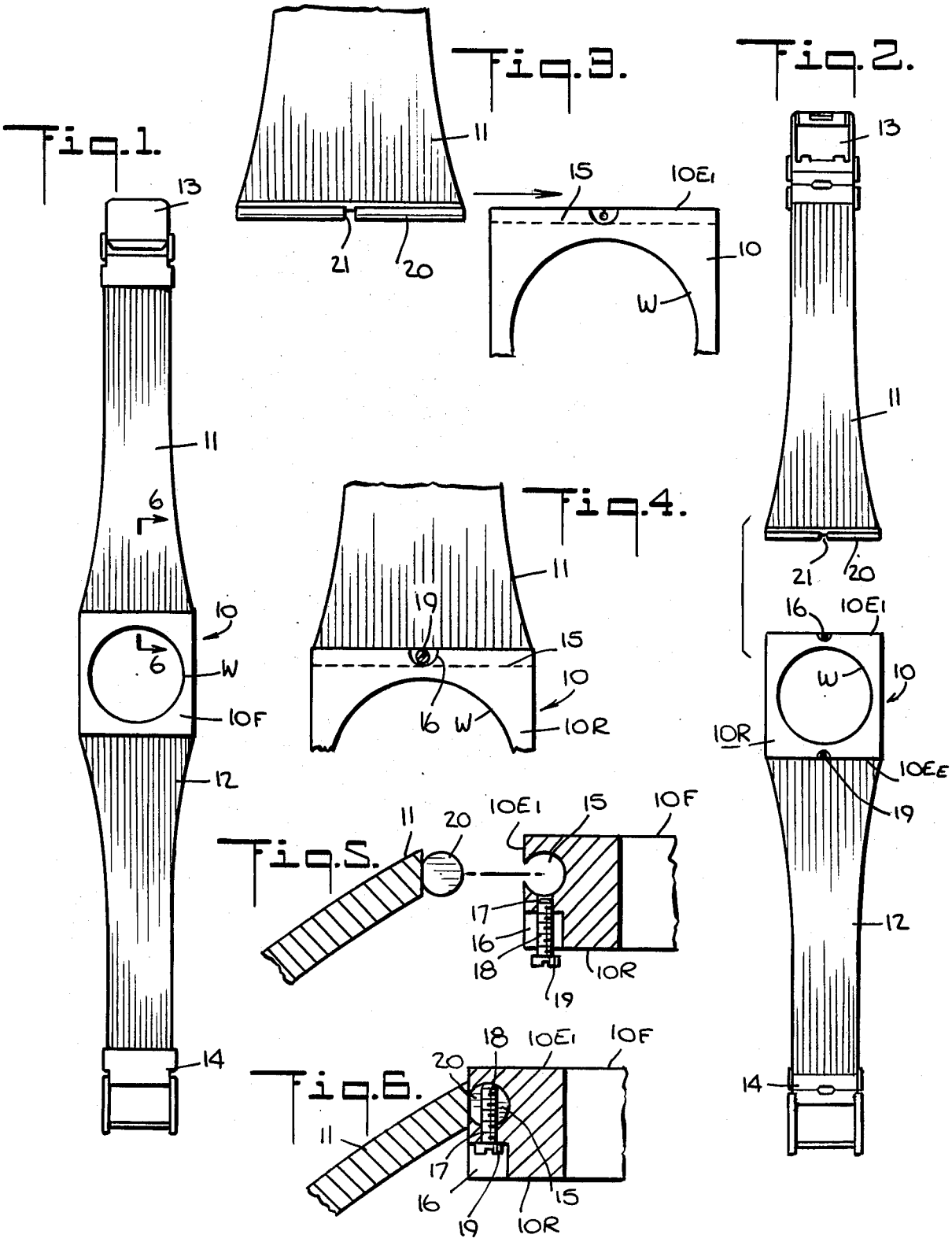
FIG. 1 is a plan view, as seen from the front face of an integrated watch case and metal bracelet assembly in accordance with the invention.
FIG. 2 is a plan view, as seen from the rear face of the same assembly, with one of the bracelet components detached from the case.
FIG. 3 illustrates the manner in which the split tail pin of one of the bracelet components slides into the groove at the complementary end of the watch case.
FIG. 4 is the same as FIG. 3, with the tail pin shown joined to the complementary end of the case.
FIG. 5 is a section showing the relationship of the tail pin to the groove in the complementary end of the case.
FIG. 6 is a section taken in the plane indicated by lines 6—6 in FIG. 1.

Referring now to FIG. 1, there is shown a watch case and metal bracelet assembly in accordance with the invention which on the visible front face thereof, as worn on the wrist of a user, appears to have a "soldered look." The assembly is comprised of a case 10 having the components 11 and 12 of a metal bracelet linked to complementary ends of the case. The fact that these components are detachable is not apparent in the front face 10F view.

The leading ends of bracelet components 11 and 12 are provided with complementary clasp elements 13 and 14, respectively, which serve to join the components when they encircle the wrist of the wearer. These elements form no part of the present invention, for other forms of connecting elements may be used for the same purpose. Hence the structure of these elements will not be detailed herein.

As the assembly is seen from the rear face 10R thereof, as shown in FIG. 2, case 10 which has a generally rectangular form with straight ends 10E and $10E_2$, is provided with a central well W adapted to receive the timekeeping movement of the watch. The shape of the watch case need not be rectangular as long as it has straight ends; hence the sides of the case may be in an arcuate or other formation. And well 15 need not be circular, as shown best in a shape appropriate to the watch movement placed therein.

Each straight end $10E_1$ and $10E_2$ of the case, as shown in connection with end $10E_1$ in FIGS. 5 and 6, has a longitudinal groove 15 extending thereacross, the groove having a circular cross section. At the midpoint of the rear face 10R of the case adjacent each end is a center notch 16, and communicating between this notch and groove 15 is a threaded bore 17. This bore is adapted to receive a holding screw 18 whose head 19 rests within the notch when the screw is turned into groove 15.

The tail of each bracelet component, as illustrated by tail 11 in FIG. 3, terminates in a split pin 20 to define a mid space 21 between the half pieces of the pin. In practice, this split pin is welded to the tail end of the bracelet component so that it is a permanent part thereof. The split pin has a diameter slightly smaller than the internal diameter of groove 15 in the end of the case, and the pin has a length equal to that of the groove.

Hence, on may, without difficulty, laterally slide the split pin 20 into groove 15, as shown in FIG. 3, whereby when the split pin is in place, its mid space 21 is then in registration with center notch 16 on the rear face 10R of the case.

When, therefore, the split pin is slid in place and holding screw 18 is turned in, the screw enters mid space 21 between the half pieces of the pin to prevent sliding movement of the pin in either direction, thereby locking it into position. And when one wishes to detach the bracelet components from the ends of the case, one simply turned out the holding screws to the extent necessary to retract them from mid spaces 21 in the pins without, however, withdrawing the screws from threaded bores 17.

Once the bracelet components are locked into the complementary ends of the case, the appearance of the assembly, as seen from front face 10F as shown in FIG. 1, is fully integrated; for the bracelet then appears to be permanently joined to the case, and the assembly has the desired "soldered look." Yet, as previously explained, one may, without difficulty, using a simple screw driver, detach the bracelet components from the case and replace these components with another set of components.

While there has been shown and described a preferred embodiment of an integrated watch case and bracelet assembly in accordance with the invention, it will be appreciated that many changes and modifications may be made therein without, however, departing from the essential spirit thereof. Thus while the pin and groove in the assembly are shown as having a circular cross section, they may have other cross-sectional shapes, as long as matching shapes are provided to permit the split pin to slide into the groove. Also, instead of a metal bracelet, the components, including the tail pins, may be molded or otherwise fabricated of synthetic plastic material such as PVC.

I claim:

1. A wrist watch case and bracelet assembly comprising:

A a case for accommodating a watch movement, said case having straight ends each provided with a longitudinal groove, the rear face of the case having at its midpoint adjacent each end thereof a threaded bore to receive a holding screw which when turned in penetrates the groove; and B a bracelet formed by two components which when joined together at their leading ends encircle the wrist of the wearer, the tail end of each component terminating in a split pin which is slidable into the groove at the complementary end of the case, said split pin having a mid space between the half pieces thereof which when the pin is in place lies in registration with the bore whereby the screw, when turned in, enters this space to lock the component to the case.

2. An assembly as set forth in claim 1, wherein the leading ends of the components are provided with coupling elements.

3. An assembly as set forth in claim 1, wherein said case has a generally rectangular shape and a well to receive said movement.

4. An assembly as set forth in claim 1, wherein said watch face is provided adjacent either end with a notch which registers with the bore to receive the head of the screw when it is turned in.

5. An assembly as set forth in claim 1, wherein said pin and said groove both have circular cross sections.

6. An assembly as set forth in claim 1, wherein said bracelet components are metallic and said pins are welded to the tail ends.

* * * * *